US005665031A

United States Patent [19]

Hsieh

[11] Patent Number: 5,665,031

[45] Date of Patent: Sep. 9, 1997

[54] DUAL ACTION EXERCISE APPARATUS

[75] Inventor: Yi Fong Hsieh, Succasunna, N.J.

[73] Assignee: LifeGear, Inc., Rockaway Township, N.J.

[21] Appl. No.: 654,526

[22] Filed: May 29, 1996

[51] Int. Cl.[6] ..... A63B 22/10

[52] U.S. Cl. ..... 482/54

[58] Field of Search ..... 482/54, 52–53, 482/51, 74, 57, 62; D21/192

[56] References Cited

U.S. PATENT DOCUMENTS

| | | | |
|---|---|---|---|
| D. 344,557 | 2/1994 | Ashby | D21/192 |
| 5,104,119 | 4/1992 | Lynch | 482/54 |
| 5,282,776 | 2/1994 | Dalebout | 482/54 |
| 5,431,612 | 7/1995 | Holden | 482/54 |
| 5,441,467 | 8/1995 | Stevens | 482/54 |
| 5,460,586 | 10/1995 | Wilkinson et al. | 482/54 |
| 5,492,517 | 2/1996 | Bostic et al. | 482/54 |

*Primary Examiner*—Stephen R. Crow
*Attorney, Agent, or Firm*—David L. Davis

[57] ABSTRACT

A treadmill provided with pivoting poles of adjustable resistance to enable a user to partake of both an upper body workout and a lower body workout. The poles are mounted about raised pivot axes at approximately the level of the knees of a user standing on the treadmill belt.

4 Claims, 1 Drawing Sheet

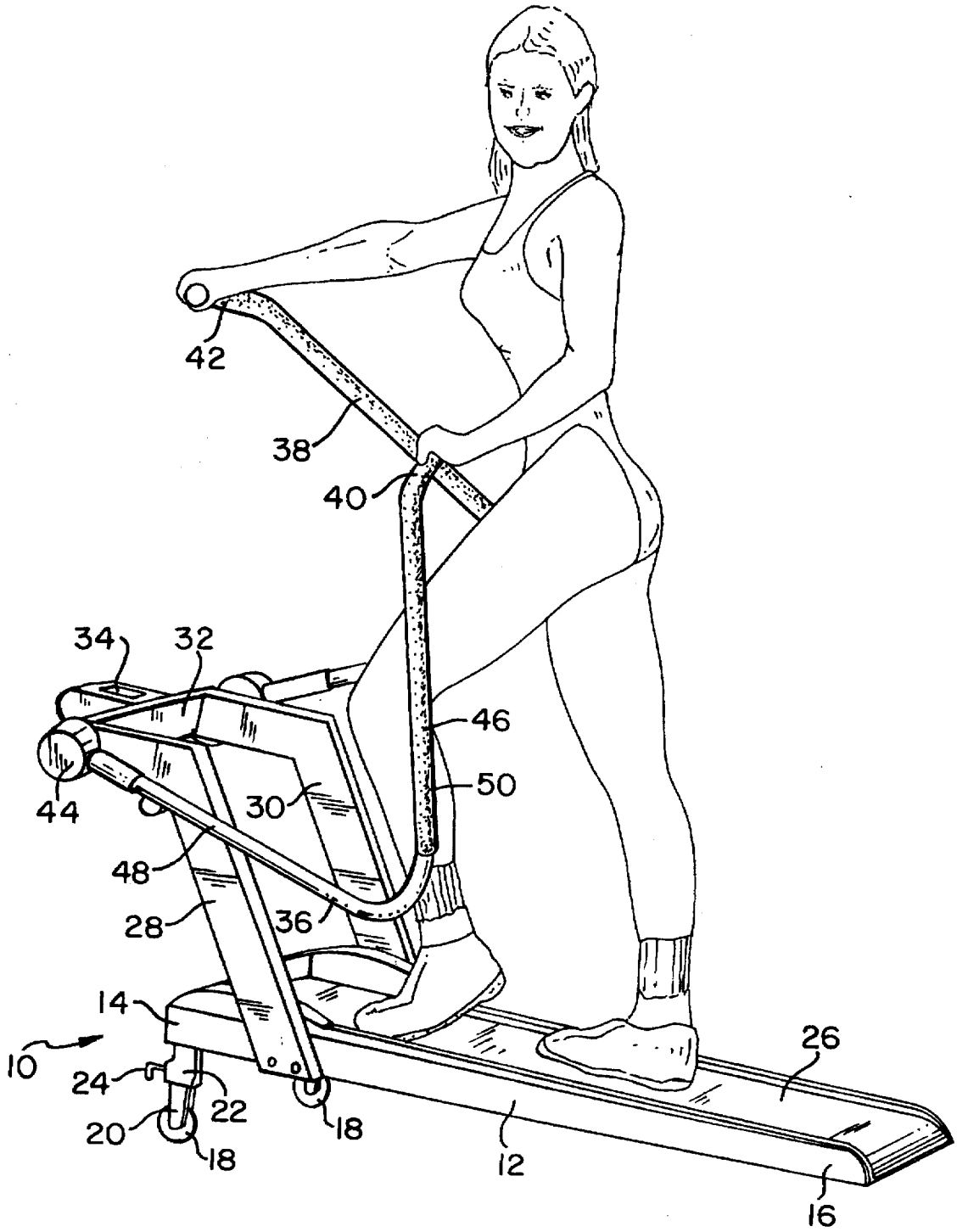
42
38
40
34
32
46
50
44
30
48
28
36
14
10
24
22
20
18
18
12
26
16

DUAL ACTION EXERCISE APPARATUS

BACKGROUND OF THE INVENTION

This invention relates to exercise apparatus and, more particularly, to exercise apparatus which facilitates both a lower body workout and an upper body workout for a user of the apparatus.

Exercise apparatus is known for providing both an upper body workout and a lower body workout. Exemplary apparatus may comprise a treadmill or a ski exercise machine which includes a pair of vertically extending poles which are pivotally mounted at the forward end of the exercise apparatus base. These poles are used for the upper body workout and are generally provided with a mechanism for adjustably varying their resistance to pivoting movement. It has been found that using the poles can be somewhat difficult for many individuals and may result in loss of balance of the user. Accordingly, such exercise apparatus is often provided with an abdominal pad against which the user can lean in order to maintain balance. The provision of this pad adds additional expense to the apparatus. It is therefore a primary object of the present invention to provide dual action exercise apparatus of the type described which eliminates the requirement for an abdominal pad.

SUMMARY OF THE INVENTION

The foregoing and additional objects are attained in accordance with the principles of this invention by providing exercise apparatus which comprises elongated base structure having a forward end and a rearward end and leg movement support means mounted to the base structure between the forward end and the rearward end for enabling a user to exercise by partaking of alternating front-to-back leg reciprocation on the support means. Upright support structure is mounted to the base structure adjacent its forward end and left and right poles are provided, each having a first end and a second end and a generally horizontal hand grip at a respective first end. Mounting means are provided for pivotally mounting the respective second ends of the left and right poles to the support structure about co-linear horizontal pivot axes, the pivot axes being spaced above the support means at approximately the level of the knees of a user standing on the support means. The mounting means further holds the left and right poles at a horizontal spacing so as to not interfere with the user's body while exercising on the support means.

In accordance with an aspect of this invention, each of the left and right poles lies generally in a respective plane orthogonal to the pivot axes between its first and second ends and is further formed of two straight line segments of substantially equal length extending between the hand grip and the second end. The straight line segments are arranged at an acute angle to each other and the mounting means further includes means for independently locking each of the left and right poles in a respective fixed position so that the poles can be positioned to function as stationary hand rails.

BRIEF DESCRIPTION OF THE DRAWING

The foregoing will be more readily apparent upon reading the following description in conjunction with the drawing in which the single figure thereof is a perspective view of dual action exercise apparatus constructed in accordance with the principles of this invention.

DETAILED DESCRIPTION

Referring now to the drawing, shown therein is exercise apparatus, designated generally by the reference numeral 10, in which is incorporated structure according to the principles of this invention. For illustrative purposes, the apparatus 10 is shown as being a treadmill which has, as is conventional, base structure 12 having a forward end 14 and a rearward end 16. Mounted to the forward end 14, below the base structure 12, are a pair of wheels 18 used for moving the apparatus 10 from place to place. Each of the wheels 18 is rotatably mounted to an upright bar 20 which is slidably received within a hollow tube 22 so that the inclination of the base structure 12 may be varied to vary the exertion level of the user. When the desired inclination is achieved, the position of the bar 20 relative to the tube 22 is secured by the locking member 24, which may be, for example, a locking pin.

As shown, the exemplary exercise apparatus 10 is a treadmill. Accordingly, an endless belt 26 forming a flat movable surface is mounted to the base structure 12 between the forward end 14 and the rearward end 16. Although a belt 26 is illustrated, it is understood that other leg movement support arrangements can be provided to enable a user to exercise by partaking of alternating front-to-back leg reciprocation on the leg movement support arrangement. Thus, for example, a ski exercise machine would include, as the leg movement support arrangement, a pair of foot platforms adapted for reciprocating sliding movement between the forward end 14 and the rearward end 16.

According to the present invention, upright support structure is mounted to the base structure 12 adjacent the forward end 14. Illustratively, this upright support structure includes a pair of upright members 28, 30 bolted or otherwise secured to the sides of the base structure 12. At the top, forward end of the upright members 28, 30 there is secured a cross member 32, which illustratively has mounted thereon a display 34 by means of which the user can keep track of time, distance, calories expended, etc.

To enable the user to partake of an upper body workout, left and right poles 36, 38, respectively, are provided. Preferably, at a first end of each of the poles 36, 38, there is a generally horizontal hand grip portion 40, 42, respectively. At their opposite ends, the poles 36, 38 are mounted to the upright support structure about co-linear horizontal pivot axes, by mounting structure which includes, for the left pole 36, a rotatable knob 44 which can be rotated in a clockwise direction to increase the resistance to pivoting movement of the left pole. When the knob 44 is rotated clockwise to an extreme position, it locks the left pole in a fixed position. Similar mounting structure is provided for the right pole 38. The pivot axes for the poles 36, 38 are spaced above the belt 26 at approximately the level of the knees of a user standing on the belt 26. It has been found that elevating the pivot axes allows the user's hands and arms to move further downwardly as the poles are pulled rearwardly than would be the case when the pivot axes are at the level of the belt 26, which is conventional in the art. This downward motion aids in the user maintaining his/her balance while exercising, thereby obviating the need for a separate abdominal support pad.

Preferably, each of the left and right poles 36, 38 lies generally in a respective plane orthogonal to its pivot axis between its hand grip and its opposite (mounting) end. The horizontal spacing between the poles 36, 38 is such that the poles 36, 38 flank the user's body and do not interfere with the user's body while the user is exercising. Preferably, each of the poles 36, 38 is formed of two straight line segments 46, 48 (in the case of the left pole 36) which are arranged at an acute angle to each other. Further, a layer of cushioning material 50 is provided to cover the hand grip 40 and the adjacent straight line segment 46.

There are times when the user may not desire to partake of an upper bodyworkout. Accordingly, the poles 36, 38 can be positioned and locked in place to act as stationary hand rails and the user may grip the cushioning material 50 while exercising.

Accordingly, there has been disclosed exercise apparatus which facilitates a lower body workout and an upper body workout for a user of the apparatus. While an illustrative embodiment of the present invention has been disclosed herein, it is understood that various modifications and adaptations to the disclosed embodiment will be apparent to those of ordinary skill in the art and it is intended that this invention by limited only by the scope of the appended claims.

What is claimed is:

1. Exercise apparatus comprising:

elongated base structure having a forward end and a rearward end;

leg movement support means mounted to said base structure between said forward end and said rearward end for enabling a user to exercise by partaking of alternating front-to-back leg reciprocation on said support means;

upright support structure mounted to said base structure adjacent said forward end;

left and right poles each having a first end and a second end and a generally horizontal hand grip at a respective first end; and mounting means for pivotally mounting the respective second ends of said left and right poles to said support structure about co-linear horizontal pivot axes, the pivot axes being spaced above said support means at approximately the level of the knees of a user standing on said support means, the mounting means holding the left and right poles at a horizontal spacing so as to not interfere with the user's body while exercising on said support means;

wherein each of said left and right poles lies generally in a respective plane orthogonal to the pivot axes between its first and second ends and is further formed of two straight line segments of substantially equal length extending between the hand grip and the second end, the straight line segments being arranged at an acute angle to each other;

wherein each of said poles further includes a layer of cushioning material covering the hand grip and the adjacent one of the two straight line segments; and wherein said mounting means further includes means for independently locking each of said left and right poles in a respective fixed position with said respective adjacent segment being selectively positionable in an angular range from substantially vertical to substantially horizontal;

whereby said poles can be positioned to function as stationary hand rails grippable along said adjacent segments.

2. The exercise apparatus according to claim 1 wherein said leg movement support means includes an endless belt forming a flat movable surface for operation as a treadmill track.

3. The exercise apparatus according to claim 1 wherein said mounting means includes means for independently adjustably varying the resistance of said left and right poles to pivoting movement about said pivot axes.

4. The exercise apparatus according to claim 1 wherein said base structure includes means for selectively varying the inclination of said leg movement support means.

* * * * *